US011359777B2

(12) United States Patent
Hou et al.

(10) Patent No.: US 11,359,777 B2
(45) Date of Patent: Jun. 14, 2022

(54) DOWNLIGHT APPARATUS

(71) Applicant: XIAMEN ECO LIGHTING CO. LTD., Xiamen (CN)

(72) Inventors: Shouqiang Hou, Xiamen (CN); Xiaoliang Wen, Xiamen (CN); Yongzhe Dong, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/877,250

(22) Filed: May 18, 2020

(65) Prior Publication Data

US 2021/0071833 A1 Mar. 11, 2021

(51) Int. Cl.

| | |
|---|---|
| ***F21S 8/02*** | (2006.01) |
| ***F21V 29/70*** | (2015.01) |
| ***F21V 5/04*** | (2006.01) |
| ***F21V 17/16*** | (2006.01) |
| ***F21V 21/04*** | (2006.01) |
| ***F21Y 115/10*** | (2016.01) |

(52) U.S. Cl.

CPC ..... *F21S 8/02* (2013.01); *F21V 5/04* (2013.01); *F21V 17/16* (2013.01); *F21V 21/04* (2013.01); *F21V 29/70* (2015.01); *F21Y 2115/10* (2016.08)

(58) Field of Classification Search

CPC .. F21S 8/02; F21S 8/026; F21V 17/16; F21V 17/164; F21V 21/04; F21V 23/008; F21V 29/70; F21V 5/04; F21V 7/0091; F21Y 2115/10

See application file for complete search history.

(56) References Cited

U.S. PATENT DOCUMENTS

| | | | | |
|---|---|---|---|---|
| 10,393,359 | B1 * | 8/2019 | Qi | F21V 21/044 |
| 10,584,858 | B1 * | 3/2020 | Boulanger | F21V 15/01 |
| 2009/0086476 | A1 * | 4/2009 | Tickner | F21V 29/70 362/231 |
| 2013/0051012 | A1 * | 2/2013 | Oehle | F21V 17/12 362/235 |
| 2013/0294084 | A1 * | 11/2013 | Kathawate | F21V 29/70 362/294 |
| 2017/0138576 | A1 * | 5/2017 | Peng | F21V 23/001 |
| 2017/0307143 | A1 * | 10/2017 | Shah | F21K 9/90 |
| 2018/0080634 | A1 * | 3/2018 | Huang | F21V 14/06 |
| 2018/0310381 | A1 * | 10/2018 | Bowen | F21V 17/12 |
| 2019/0063736 | A1 * | 2/2019 | Zeng | F21V 14/02 |
| 2019/0101266 | A1 * | 4/2019 | Shah | F21V 17/18 |
| 2019/0254139 | A1 * | 8/2019 | Van Winkle | H05B 47/10 |
| 2020/0132278 | A1 * | 4/2020 | Portinga | F21V 23/001 |

* cited by examiner

*Primary Examiner* — Tsion Tumebo

(74) *Attorney, Agent, or Firm* — Chun-Ming Shih; Lanway IPR Services

(57) ABSTRACT

A downlight apparatus includes a unibody housing, a light source, a light source plate, a first fixing unit, a lens module and a second fixing unit. The unibody housing is made of metal material. The unibody housing has a light source holder and a heat sink rim. The heat sink rim has a top edge and a bottom edge. The top edge is connected to the light source holder. The top edge has a smaller diameter than the bottom edge. The light source plate is used for mounting the light source. The lens module is fixed between the first fixing unit and the second fixing unit to align a center of the lens module with the light source. The second fixing unit is fixed to a peripheral edge of the light source holder for keeping the lens module, and the light source plate staying in the light source holder.

18 Claims, 15 Drawing Sheets

DOWNLIGHT APPARATUS

FIELD

The present application is related to a downlight apparatus and more particularly related to a downlight apparatus used in commercial environment.

BACKGROUND

Electroluminescence, an optical and electrical phenomenon, was discover in 1907. Electroluminescence refers the process when a material emits light when a passage of an electric field or current occurs. LED stands for light-emitting diode. The very first LED was reported being created in 1927 by a Russian inventor. During decades' development, the first practical LED was found in 1961, and was issued patent by the U.S. patent office in 1962. In the second half of 1962, the first commercial LED product emitting low-intensity infrared light was introduced. The first visible-spectrum LED, which limited to red, was then developed in 1962.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area.

Unlike modern LEDs which are bound in transparent plastic cases, LEDs in early stage were packed in metal cases.

With high light output, LEDs are available across the visible, infrared wavelengths, and ultraviolet lighting fixtures. Recently, there is a high-output white light LED. And this kind of high-output white light LEDs are suitable for room and outdoor area lighting. Having led to new displays and sensors, LEDs are now be used in advertising, traffic signals, medical devices, camera flashes, lighted wallpaper, aviation lighting, horticultural grow lights, and automotive headlamps. Also, they are used in cellphones to show messages.

A Fluorescent lamp refers to a gas-discharge lamps. The invention of fluorescent lamps, which are also called fluorescent tubes, can be traced back to hundreds of years ago. Being invented by Thomas Edison in 1896, fluorescent lamps used calcium tungstate as the substance to fluoresce then. In 1939, they were firstly introduced to the market as commercial products with variety of types.

In a fluorescent lamp tube, there is a mix of mercury vapor, xenon, argon, and neon, or krypton. A fluorescent coating coats on the inner wall of the lamp. The fluorescent coating is made of blends of rare-earth phosphor and metallic salts. Normally, the electrodes of the lamp comprise coiled tungsten. The electrodes are also coated with strontium, calcium oxides and barium. An internal opaque reflector can be found in some fluorescent lamps. Normally, the shape of the light tubes is straight. Sometimes, the light tubes are made circle for special usages. Also, u-shaped tubes are seen to provide light for more compact areas.

Because there is mercury in fluorescent lamps, it is likely that the mercury contaminates the environment after the lamps are broken. Electromagnetic ballasts in fluorescent lamps are capable of producing buzzing mouse. Radio frequency interference is likely to be made by old fluorescent lamps. The operation of fluorescent lamps requires specific temperature, which is best around room temperature. If the lamps are placed in places with too low or high temperature, the efficacy of the lamps decreases.

In real lighting device design, details are critical no matter how small they appear. For example, to fix two components together conveniently usually brings large technical effect in the field of light device particularly when any such design involves a very large number of products to be sold around the world.

It is also important to consider how to conveniently install a lighting apparatus. Particularly, many societies face aging problems. More and more old people need to replace or install lighting devices by themselves. Labor cost for installing lighting devices is also increasing. It is therefore beneficial to design a better way to install various lighting devices.

Downlight apparatuses are widely used in various locations. For commercial use, the downlight apparatuses usually need high power LED devices. In such use, it is particularly important to handle heat dissipation. However, the cost is also a great factor to be considered. Therefore, it is beneficial to design a downlight apparatus with nice heat dissipation efficiency while keeping with low manufacturing cost.

SUMMARY

In some embodiments, a downlight apparatus includes a unibody housing, a light source, a light source plate, a first fixing unit, a lens module and a second fixing unit.

The unibody housing is made of metal material. The unibody housing has a light source holder and a heat sink rim. The heat sink rim has a top edge and a bottom edge. The top edge is connected to the light source holder. The top edge has a smaller diameter than the bottom edge.

The light source plate is used for mounting the light source. The lens module is fixed between the first fixing unit and the second fixing unit to align a center of the lens module with the light source. The second fixing unit is fixed to a peripheral edge of the light source holder for keeping the lens module, and the light source plate staying in the light source holder.

In some embodiments, the downlight apparatus may also include a back cover attached on a top side of the light source holder.

In some embodiments, the light source plate is fixed on the back cover.

In some embodiments, the back cover is made of metal material.

In some embodiments, the back cover has a socket for plugging a terminal of a connecting wire. The terminal of the connecting wire has a standard IDEAL plug structure.

In some embodiments, the light source holder has a lateral connector for fixing to a metal spring to transmit heat on the light source holder to the metal spring. The metal spring has multiple fins.

In some embodiments, the light source is a LED chip on board (COB) module. The first fixing unit has an escape hole exposing the light source toward the lens module.

In some embodiments, a connector wire is extended from the light source plate. The connector wire has a light terminal connected to a driver terminal of a driver box.

In some embodiments, the driver box has a manual switch to adjust a setting of a driver circuit enclosed by the driver box.

In some embodiments, the light terminal has an identifier circuit providing an identification message corresponding to a type associated to the downlight apparatus to a driver circuit in the driver box.

In some embodiments, the driver circuit checks a table for finding a corresponding setting for the type indicated by the identification message.

In some embodiments, the driver circuit has multiple driver modules and selects one driver module to activate according to the identification message.

In some embodiments, the lens module has more than three ring reflection structures facing to the light source. The ring reflection structure closer to the light source has a smaller diameter than the ring reflection structure more away from the light source.

In some embodiments, the reflection structure has a vertical surface and a tilt surface connected at a bottom end facing downward to the light source plate.

In some embodiments, the vertical surface is attached with reflective material.

In some embodiments, the first fixing unit has an escape hole exposing the light source toward the lens module and has an escape groove for storing a wire connected to the light source plate.

In some embodiments, the first fixing unit has protruding blocks engaging an inner surface of the light source holder for enhancing heat dissipation.

In some embodiments, an exterior edge of the lens module is held by an inner connector of the second fixing unit. The inner connector is located an inner side of the second fixing unit.

In some embodiments, an external connector is rotated to be locked to a protruding structure extended from an inner surface of the light source holder.

In some embodiments, the heat sink rim has a reflective layer in an inner surface of the heat sink rim.

DETAILED DESCRIPTION

Figure 1:
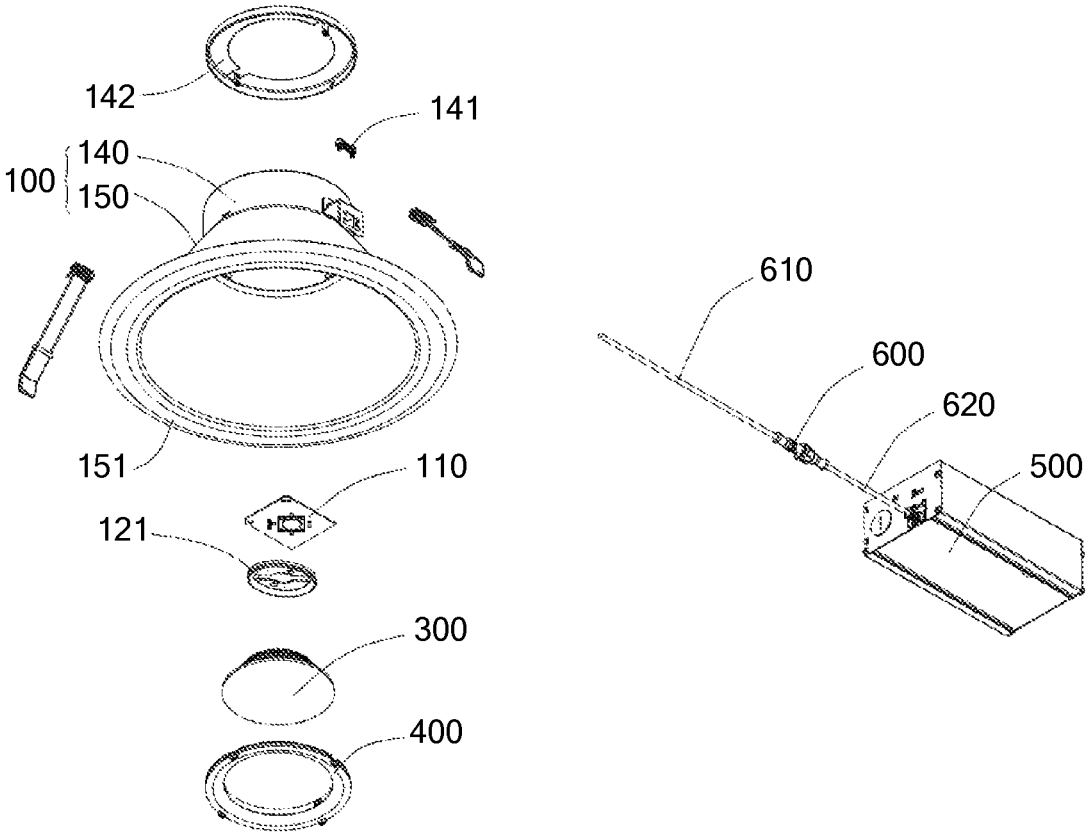
FIG. 1 illustrates an exploded view of a downlight apparatus embodiment.

Reference may now be made in detail to particular embodiments of the disclosure, examples of which are illustrated in the accompanying drawings. While the disclosure may be described in conjunction with the preferred embodiments, it may be understood that they may not intended to the limit the disclosure to these embodiments. On the contrary, the invention is intended to cover alternatives, modifications and equivalents that may be included within the spirit and scope of the disclosure as defined by the appended claims. Furthermore, in the following detailed description of the present disclosure, numerous specific details are set forth in order provide a thorough understanding of the present disclosure. However, it may be readily apparent to one skilled in the art that the present disclosure may be practiced without these specific details. In other instances, well-known methods, procedures, processes, components, structures, and circuits have not been described in detail so as not to unnecessarily obscure aspects of the present invention.

Please refer to FIG. 1 to FIG. 16, which illustrate a downlight apparatus embodiment.

The downlight apparatus includes a light housing 100, a light source module 200, a lens module 300 and a second fixing unit 400. The light source module 200 includes a light source and a light source plate. The light source is mounted on the light source plate.

There is a protruding structure 130 extended from an inner surface of the light housing 100. The light source module 200 is fixed by a first fixing unit 121 to keep at an inner top position of a light source holder of the light housing 100. The lens module 300 is connected to the first fixing unit 121 to align a center of the lens module with the light source of the light source module 200.

An inner connector of the second fixing unit 400 is connected to the lens module 300. An external connector 421 of the second fixing unit 400 is connected to the protruding structure 130.

In the embodiment, the lens module is clipped by the first fixing unit and the second fixing unit at two opposite ends to effectively align the lens module with the light source. Such alignment is important to provide an efficient light device, particularly in commercial use.

Please refer to FIG. 1 to FIG. 6. The light source module 200 includes a light source plate 110 and a light source fixed below the light source plate 110. The light source plate 110 may be a printed circuit board. There are connecting wires disposed on the light source plate 110. The light source plate 110 is fixe to the light housing 100 by the first fixing unit 121. The first fixing unit 121 includes an escape hole 123 for exposing the light source toward the lens module. The first fixing unit 121 also includes an escape groove 124 for storing the connector wire. The first fixing unit 121 also has a first fixing part 122, which is disposed cross the escape groove 124.

In some embodiments, the light source is made of COB (Chip On Board) form. Specifically, the COB light source is made by attaching a LED die directly on a metal base board, which provide high efficiency of light and low manufacturing cost.

Chip on board (COB) is the method of manufacturing where integrated circuits are wired and bonded directly to a printed circuit board. By eliminating the packaging of individual semiconductor devices, the completed product can be more compact, lighter, and less costly. In some cases, the chip on board construction improves the operation of radio frequency systems by reducing the inductance and capacitance of integrated circuit leads. Chip on board effectively merges two levels of electronic packaging, level 1 (components) and level 2 (wiring boards), and may be referred to as "level 1.5."

Chip on board is an assembly method used in manufacturing. Basically, the method needs materials such as circuit board, silver glue and A1 wire. In the method, die is glued directly on printed circuit board. There are three methods to connect the die and the printed circuit board: flip chip on board, wire bonding and tape-automated bonding. With the technology of COB, the packaging and testing steps in the integrated circuit manufacturing process are transferred to the circuit board assembly stage, and the product can be more compact. COB is used in variety of nowadays electronic products, such as laptops, mobile phones, LEDs and toys.

COB LED is a method of LED packaging. In this technology, multiple LED chips are bonded directly to the substrate. The chips take less space and highest potential of chips can be obtained. Compared with traditional assembly method, COB method has fewer welding points, and further reduces the failure rates. Due to the small size of LED chip, the LED light arrays produced are more compact. Also, the light arrays have high-intensity, high-uniformity and with longer lifespan, stability and reliability. However, the drawback of COB LEDs is that they are so far only available for limited colors. COB LEDs can be found in streetlight, high-bay lighting and downlights.

A finished semiconductor wafer is cut into dies. Each die is then physically bonded to the PCB. Three different methods are used to connect the terminal pads of the integrated circuit (or other semiconductor device) with the conductive traces of the printed circuit board.

In "flip chip on board", the device is inverted, with the top layer of metallization facing the circuit board. Small balls of solder are placed on the circuit board traces where connections to the chip are required. The chip and board are passed through a reflow soldering process to make the electrical connections.

In "wire bonding", the chip is attached to the board with an adhesive. Each pad on the device is connected with a fine wire lead that is welded to the pad and to the circuit board. This is similar to the way that an integrated circuit is connected to its lead frame, but instead the chip is wire-bonded directly to the circuit board.

In "tape-automated bonding", thin flat metal tape leads are attached to the device pads, then welded to the printed circuit board.

In all cases, the chip and connections are covered with an encapsulant to reduce entry of moisture or corrosive gases to the chip, and to protect the wire bonds or tape leads from physical damage.

The printed circuit board substrate may be assembled into the final product, for example, as in a pocket calculator, or, in the case of a multi-chip module, the module may be inserted in a socket or otherwise attached to yet another circuit board. The substrate wiring board may include heat-dissipating layers where the mounted devices handle significant power, such as in LED lighting or power semiconductors. Or, the substrate may have low-loss properties required at microwave radio frequencies.

In some embodiments, the first fixing unit 121 is detachably connected to a top position of an inner side of a light holder of the light housing 100.

The first fixing unit 121 is connected to the light housing 100 by a bolt connection or other connecting methods, e.g. via glue or a buckle connection.

The light source plate 110 is used for fixing the light source. The light source, e.g. COB module, is disposed below the light source plate 110. The light source has a light emitting area exposed from an escape hole 123. The escape groove 124 is disposed for storing the connector wire to prevent instable connection due to the protruding of the connector wire.

The first fixing part 122 is used for fixing an end of the first conductor wire 610 from the escape groove 124.

Please refer to FIG. 1 to FIG. 5. The first fixing part 122 is an arc unit extended from the first fixing unit 121.

The escape hole 123 is disposed at a center position of the first fixing unit 121.

Figure 6:
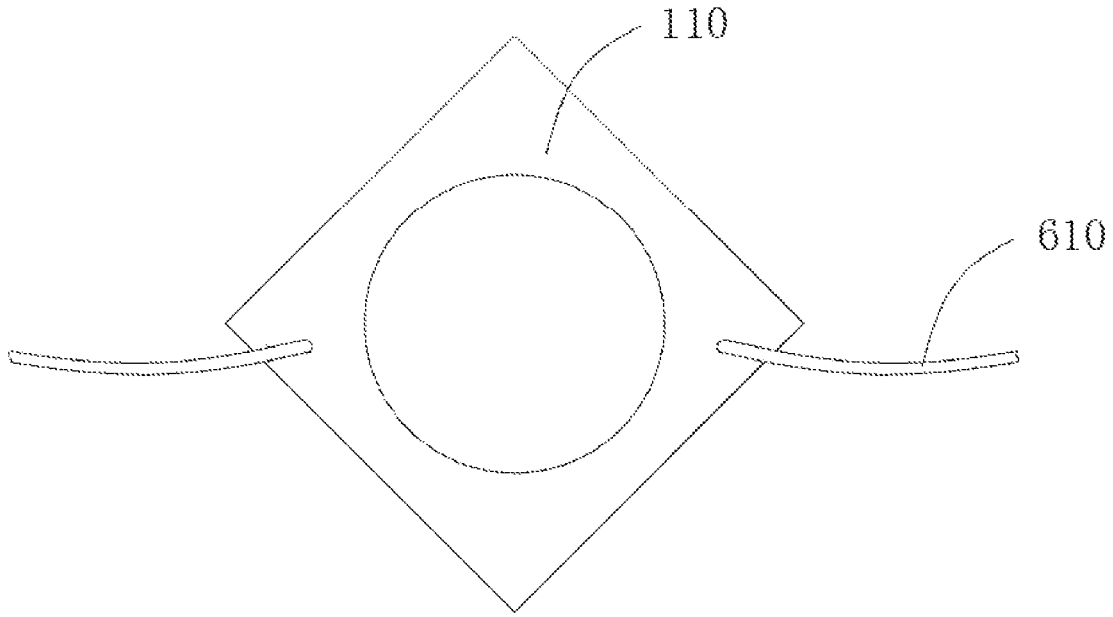
FIG. 6 illustrates a light source example.
Figure 7:
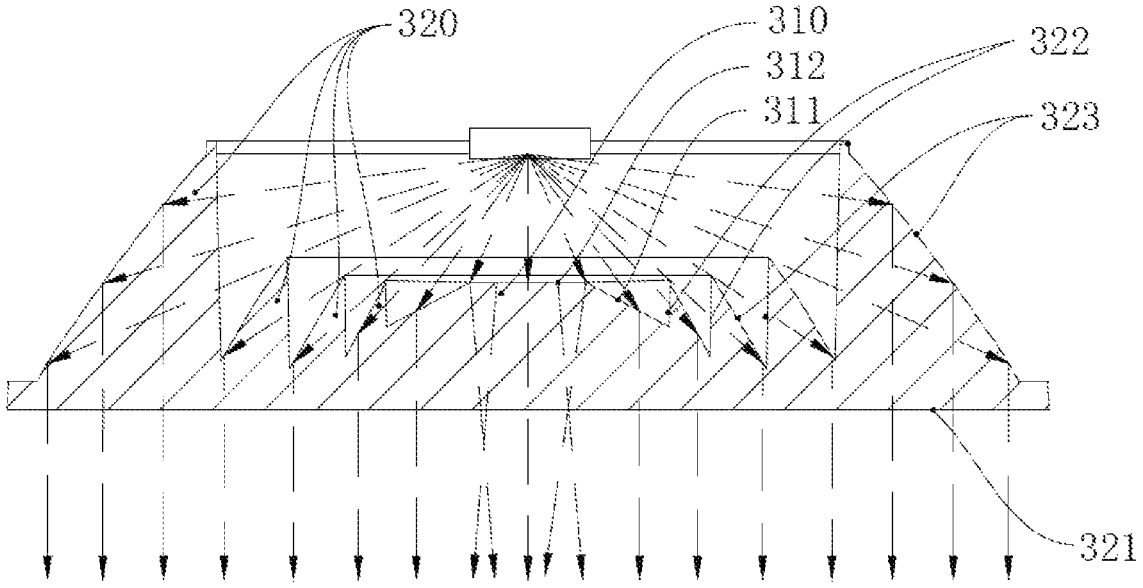
FIG. 7 illustrates a lens module example.
Figure 8:
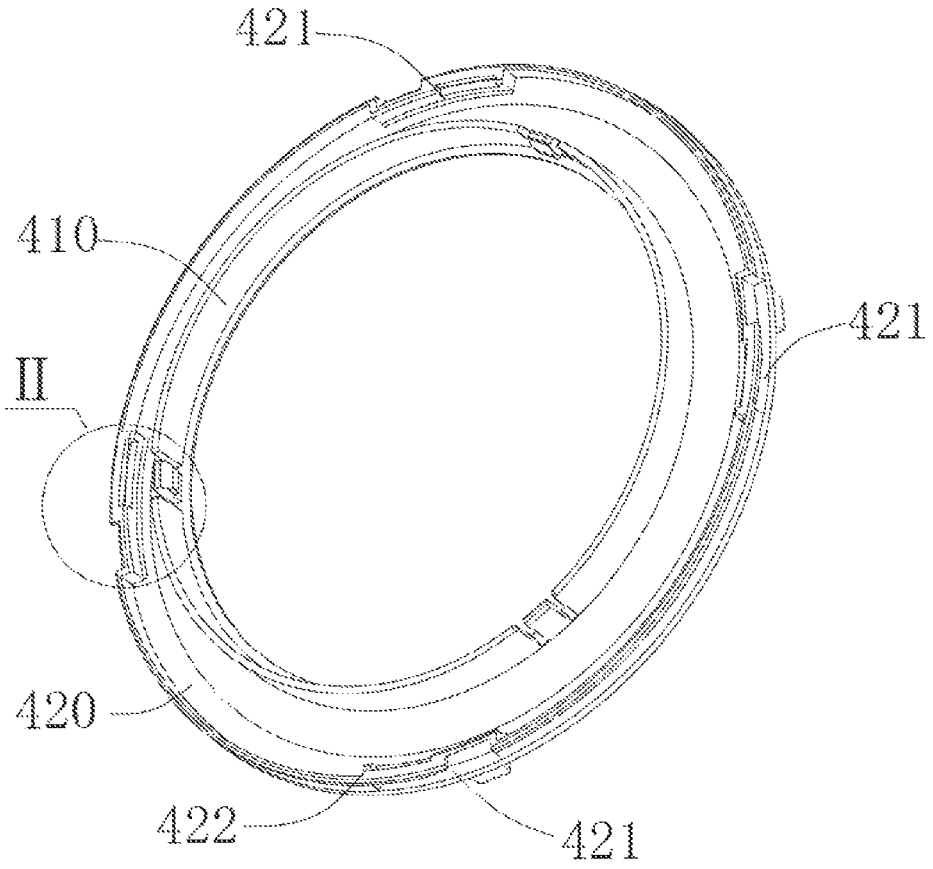
FIG. 8 illustrates an example of a second fixing unit.

Please refer to FIG. 6 to FIG. 8. The second fixing unit 400 includes an inner connector 410 and an external connector 420. The inner connector 410 engages an exterior edge of the lens module 300. The inner connector 410 has two hooks 411 for hooking a bottom edge of the lens module 300. The external connector 420 is located at exterior edge of the second fixing unit 400. The second buckle unit 421 is located at edge of the external connector 420.

Figure 9:
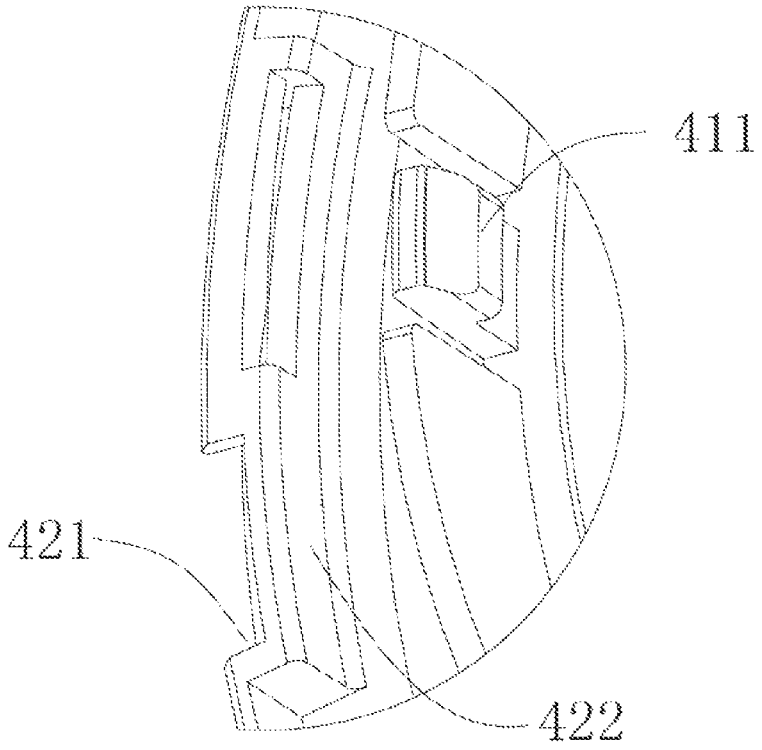
FIG. 9 illustrates a zoom-up view of an area of the example in FIG. 8.
Figure 10:
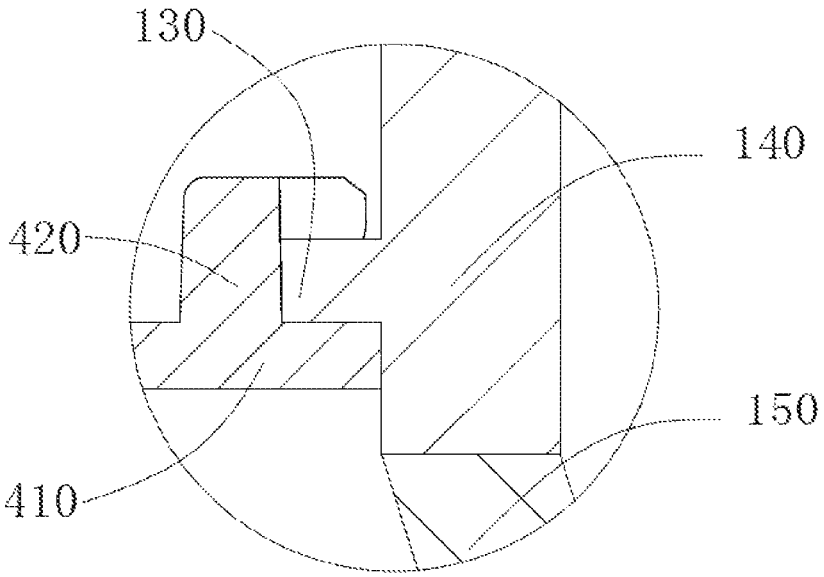
FIG. 10 illustrates connection between the second fixing unit and the light source holder.

Please refer to FIG. 8 to FIG. 10. The protruding structure 130 is a protruding bar extended from an inner surface of the light housing 100. The second buckle unit 421 is a rotation groove. The rotation groove has a guiding groove and a circumferential groove. The circumferential groove is extended at a circumferential direction of the external connector 420 for receiving the protruding structure 130.

The circumferential groove has a tilt angle upwardly so as to fasten and provide an easy installation structure.

There is a strength bar 422 disposed on the external connector 420 corresponding to the rotation groove for enhancing structure strength.

Figure 2:
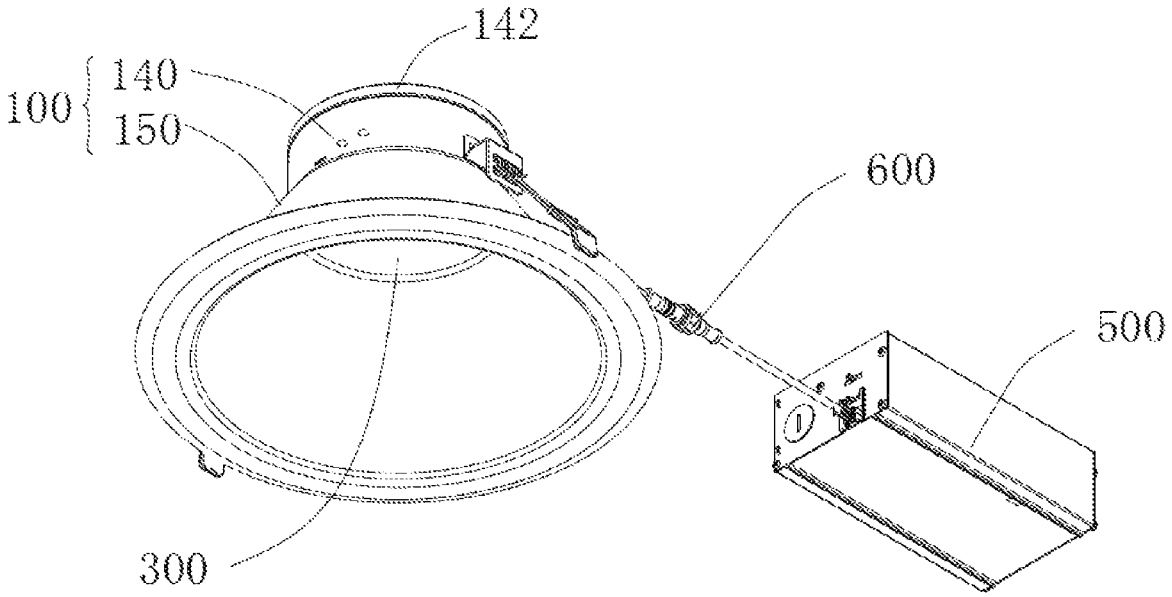
FIG. 2 illustrates the downlight apparatus.
Figure 3:
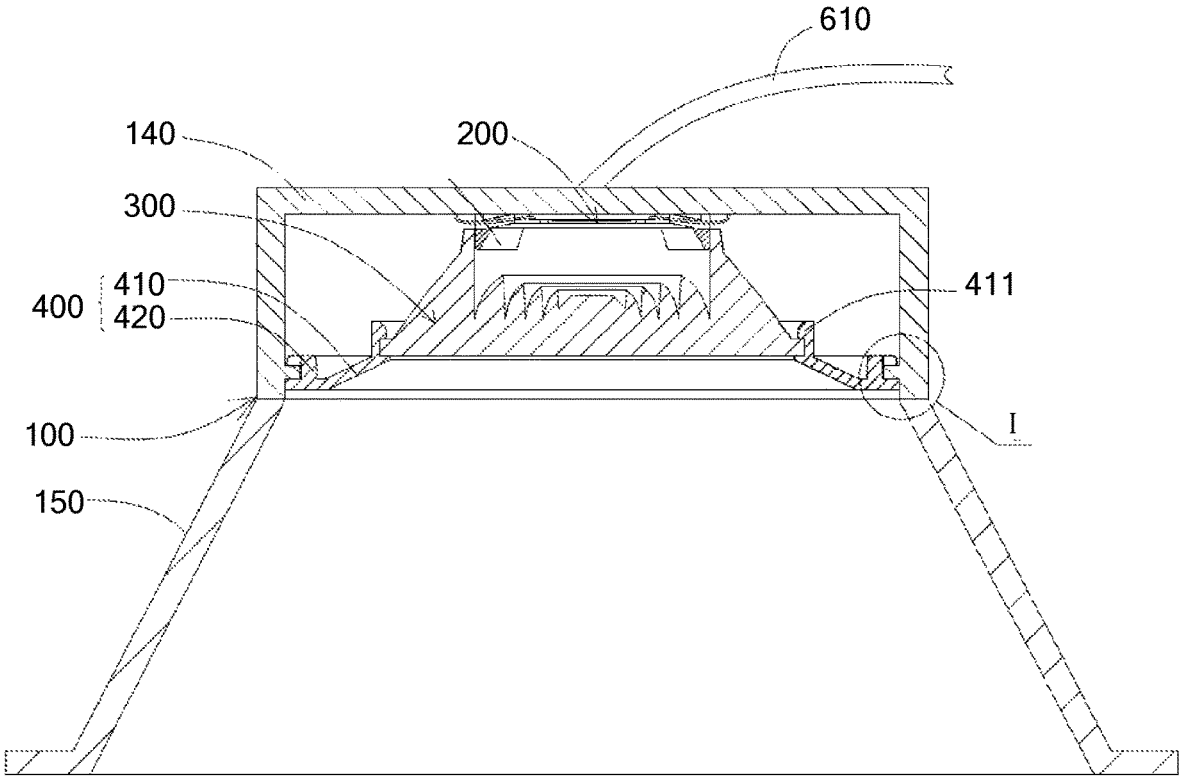
FIG. 3 illustrates a cross-sectional view of the embodiment.

Please refer to FIG. 1, FIG. 2 and FIG. 3. The light housing 100 includes a light source holder 140 and a heat sink rim 150. There is an opening at a bottom of the light source holder 140. The light source module 200 is fixed to an inner top position of the light source holder 140.

The protruding structure 130 is disposed at an inner surface of the light source holder 140. The heat sink rim 150 has a top edge and a bottom edge. The top edge of the heat sink rim 150 is connected to the light source holder 150. The diameter of the top edge of the heat sink rim 150 is smaller than the diameter of the bottom edge of the heat sink rim 150.

When the light source module 200 emits light, generated heat is dissipated to a cavity defined by the heat sink rim 150. The light housing 100 may be made as a unibody structure of metal material, like aluminum material, including both the light source holder 140 and the heat sink rim 150. The inner surface of the heat sink rim 150 absorbs heat and transmits the heat to other portion to perform heat dissipation.

With such design, there is no need to provide an additional heat sink while providing nice heat dissipation efficiency.

The heat sink rim 150 may also provide certain light reflection. In some embodiments, the inner surface of the heat sink rim 150 is attached with a reflective layer made of reflective material, e.g. white material.

In FIG. 1, there is a surface rim 151 disposed below the heat sink rim 150. The surface rim 151 may be the same one-piece structure made together with the heat sink rim 150. The surface rim 151 engages a ceiling and is exposed from an installation cavity of the ceiling.

In some embodiments, a top wall of the light source holder 140 has a through hole for passing a first connector wire 610. There is a second fixing part 141 disposed on an exterior surface of the top wall of the light source holder 140 for fixing the connector wire 610.

To prevent the first connector wire 610 to shake randomly, the second fixing part 141 is attached to a back cover that is fixed to the top wall of the light source holder 140. The back cover may be fixed to the top wall of the light source holder 140 with screws, bolt or buckle structures. The first connector wire 610 is partly stored between the back cover and the top wall of the light source holder 140.

In some embodiments, the back cover 142 is used for shielding the first connector wire 610. A through hole is disposed on the back cover 142 for the first connector wire 610 to pass through.

The back cover 142 may be buckled to the top wall of the light source holder 140. The back cover 142 may have a buckle structure and the top wall of the light source holder 140 has a buckle hole. The buckle structure of the back cover 142 is inserted into the buckle hole to buckle the back cover 142 to the top wall of the light source holder 140.

In FIG. 7, the lens module 300 includes a refraction unit 310 and multiple ring-shape reflection structures 320. One surface of the refraction unit 310 is extended outwardly forming a light input curve surface 311. There is a flat surface 312 in the center position of the curve surface 311 for light to enter directly.

Lens structure refers to an optical device refracting light sources. Through lens, the original light beam can be focused or dispersed. The first lens can be found before AD. In 13th century, lens was firstly used in commercial settings in Europe. Lens is made of glass or plastic. Lens can be molded to any desired shapes. Normally, both surfaces of a lens are spherical. To create more effects, planer, concave, or convex are also possible shapes for the surfaces. According to the curvature of the surfaces, lens can be divided into six categories: biconcave, biconvex, Plano-concave, plano-convex, negative meniscus, and positive meniscus. Other types of lens includes Fresnel, lenticular, axicon, cylindrical, and gradient index.

In this example, more than three reflection structures 320 are disposed surrounding the refraction unit 310 one layer by another. Each reflection structure 320 has a vertical surface 322 and a tilt surface 323. The tilt surface 323 provides input light to reflect to a desired direction. The vertical surfaces 322 are in parallel. The light from the light source is refracted or reflected by the lens module to escape from the escape surface 321 of the lens module. Light enters the reflection structure 320 via the vertical surface 322 substantially perpendicular to the light source plate below the lens module. Light enters from the vertical surface 322 is reflected by the tilt surface 323 to escape from the escape surface 321. By adjusting the tilt angles of the tilt surfaces 323, the output light from the escape surface 321 is adjusted to a desired light beam or a diffused smooth light.

In this example, the vertical surface 322 for receiving light and the tilt surfaces 323 of the same reflection structure 320 is extended facing a direction away from the escape surface 321 and cross to each other. The reflection focus points of the multiple reflection structures 320 are the same and overlaps the refraction focus point of the refraction unit 310.

The light source of the light source module 200 is placed at the overlapped position of the refraction focus point and the reflection focus point. A portion of the light of the light source enters the curve surface 311 into the refraction unit 310. Such light is refracted and escapes from the escape surface 321 with a direction perpendicular to the escape surface 321. For the light enters the refraction unit 310 with a perpendicular angle is not refracted and escape from the escape surface 321 with a perpendicular angle with respect to the escape surface 321.

The flat surface 312 generates minor refraction to light to prevent a strong intensity light pattern appeared at the center of the output light to keep the overall light pattern appear evenly.

In the example, the refraction occurs in addition to reflection on the reflection structures 320. A light beam of 10 degrees tilt is obtained when light of the light source pass through the lens module from the escape surface 321 of the lens module.

The relative position between the light source and the lens module is adjusted to change light input angles. Such adjustment changes a light beam angle output from the escape surface 321, e.g. to obtain a light beam angle between 10 degrees to 90 degrees.

A screw platform may be used for adjusting the relative position between the light source and the lens module. For example, the lens module is located on a shifting platform that users may rotate to change a shift position relative to the light source plate mentioned above.

The lens module includes both the refraction and reflection functions and thus is minimized for its size while providing desired optical guiding functions.

Figure 11:
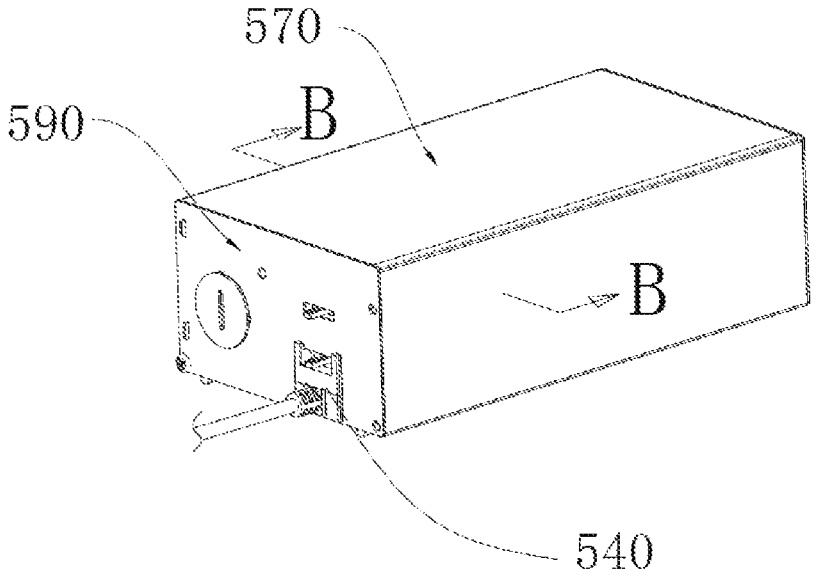
FIG. 11 illustrates a driver box example.
Figure 12:
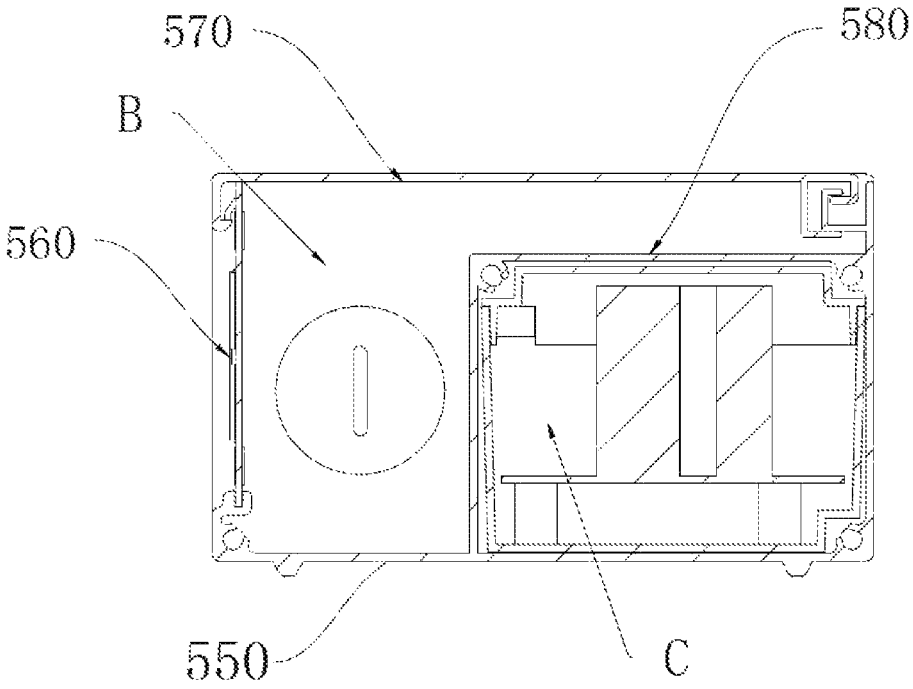
FIG. 12 illustrates another view of the driver box example.
Figure 13:
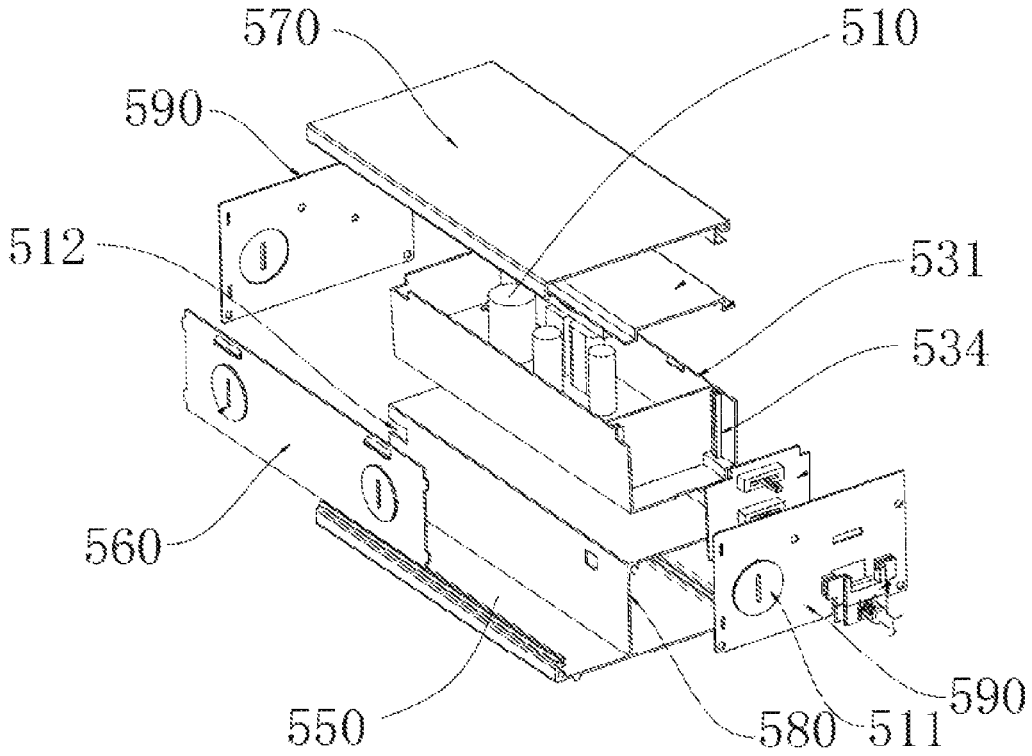
FIG. 13 illustrates an exploded view of the driver box example.
Figure 14:
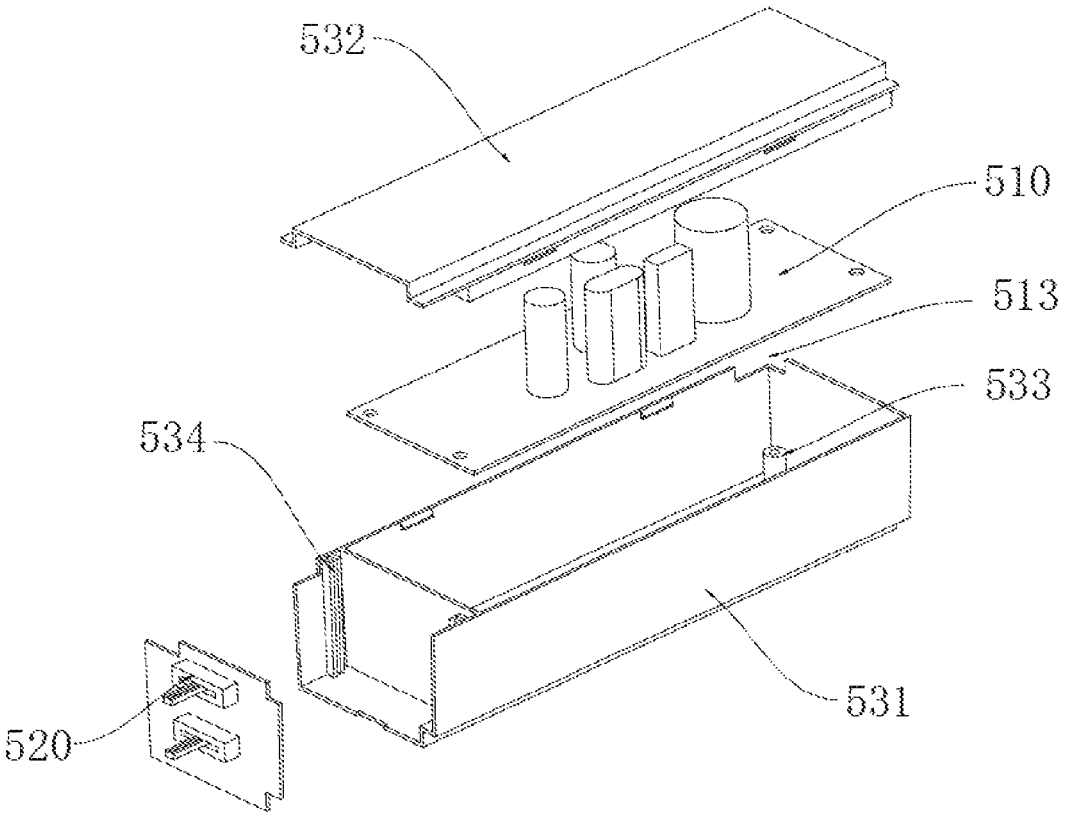
FIG. 14 illustrates another view of the example in FIG. 13.

In FIG. 11 and FIG. 14, the downlight apparatus also includes a driver box 500 connected to the downlight apparatus with a second connector wire 620. There is a block unit disposed in the driver box 500. The driver box 500 is divided into a container C and a wiring container B. There is a wire passing hole 512 on the block unit for guiding wires of the driver circuit 510.

There is a second box fixed in the container C for placing the driver circuit 510. The second box is made of plastic material which is insulated from electricity to prevent electric shock on the surface of the driver box 500 due to the driver circuit 510. The connector wire from the driver circuit 510 passes the second wiring hole 512 and the third wiring hole 513 to the container B.

There is a first wiring hole 511 on a lateral wall of the first box. The second connector wire 620 passes through the first wiring hole to the container B. In the container B, the second connector wire 620 is connected to the connector wire of the driver circuit 510.

There is a plugging portion and a third fixing part. The driver circuit 510 is fixed by the third fixing part. A manual switch 52 of the driver circuit 510 is fixed on the plugging portion to connect the manual switch 520 and the driver circuit 510.

The driver box 500 is divided as a first box and a second box. The block unit divides the first box into a container C and a container B. The wiring is performed completely inside the container B without interfering with the device stored in the container C. The connector wire of the driver circuit 510 passes through the second wiring hole and the third wiring hole to the container B and then lead out of the driver box 500 from the first wiring hole.

The second box is placed inside the container C. The second box uses a plastic material to insulate the driver circuit in the second box for preventing electric leakage.

The second connector wire 620 passes through the first wiring hole 511 entering the container B and connects to the connector wire of the driver circuit 510. If the second connector wire 620 is dragged by an external force, the connection between the second connector wire 620 and the connector wire of the driver circuit 510 may be broken.

A wire fixing clip 540 is disposed in the first wiring hole 511 to prevent the connection of the second connector wire 620 damaged. There is a limiter block on the second connector wire 620. The limiter block is disposed on an inner side of the wire fixing clip 540 and the second conductor wire 620 is fixed on the wire fixing clip 540 so as to fix to the first wiring hole 511. When the second connector wire 620 is pushed, the pulling force is applied on the driver box 500 instead of the connector position between the second connector wire 620 and the connector wire of the driver circuit 510.

The second box includes a bottom housing 531 and a top cover 532. The bottom housing 531 is a rectangular box with a top opening. The top cover 532 is a rectangular cover. The top cover 532 is buckled to the opening of the bottom housing 531.

In the four lateral walls of the bottom housing 531, two longer plates are lateral plates and two shorter plates are terminal plates. The two lateral plates are facing to each other and the two terminal plates are facing to each other.

The bottom plate of the bottom housing 531 and the two lateral plates are protruding from one of the terminal plates. Specifically, the terminal plate divides the bottom housing 531 as two areas. The third fixing part is placed at a larger area for storing the driver circuit 510. The plugging portion is placed at a smaller area for installing a manual switch 520.

The driver circuit 510 has a fixing plate. the third fixing part is placed on the bottom plate. The fixing plate of the driver circuit 510 is fixed to the third fixing part.

The third wire passing hole 513 is disposed in the larger area and on the lateral plate closer to the block unit to ensure the third wire passing hole facing to the second wire passing hole 512 when the second box is placed in the container C.

Preferably, the installation plate of the driver circuit 510 is a rectangular plate. There are four through holes at four corners of the rectangular plate. The third fixing part are four fixing columns 533 disposed on the bottom housing 531. The four fixing columns 533 are distributed as a rectangular shape and each fixing column corresponds to a through hole of the rectangular plate. There is a screw hole inside each fixing column.

When installing the driver circuit 510, the installation plate of the driver circuit 510 is placed on the four fixing columns 533. The four through holes are facing to four screw holes. Screws are installed into the screw holes via the through holes. The top head of the screws are pressing on a top surface of the installation plate.

The plugging portion are vertical slots 534. The vertical slots 534 are placed at two lateral inner surface of the bottom housing 531. There is a switch plate for the manual switch 520. The switch plate is a rectangular plate. By inserting the switch plate into vertical slots 534, the manual switch 520 is fixed to the plugging portion.

There is a strip hole on a lateral wall of the first housing for allowing an operation lever to extend outwardly. The operation lever is used for controlling the manual switch 520.

The first box includes a support plate 550, a block plate 560 and a top plate 570. The support plate 550 includes a rectangular bottom plate and a lateral plate connected to one side of the bottom plate. The bottom plate and the lateral plate form a L shape structure.

The block plate 560 is detachably connected to a long side of the support plate 550. The block plate 560 and the support plate 550 form a U-shape housing. The top plate 570 is a rectangular plate buckled to the block plate 560 and the support plate 550.

One side of the top plate 570 is detachably connected to the block plate 560.

The housing 580 and the top plate 570 may have plugging devices in some embodiments. The housing 5080 and the support plate 550 together form the container C. The bottom plate of the support plate 550, the block plate 560 and the top plate 570 of the first box together form the container B.

To ensure the container C and the container B as sealed containers, there is a sealing plate 590. The sealing plate 590 blocks two ends of the container C and the container B. The first wire passing hole 511 is placed on the block plate 590 for the second connector wire entering the container B.

The first wire passing hole 511 is blocked by a detached end cover forming a press-to-leave hole. The container C and the container B are blocked by their two ends with block plates 590. There is a first wire passing hole 511 on both block plates 590. The second connector wire 620 passes from one of the first wire passing hole into the container B. The other wire passing hole 511 is kept unused. The press-to-leave hole 560 for guiding the second connector wire 620 into the first wire passing hole 511 is removed to keep the end cover of the first wire passing hole of the other side to keep closure of the container B and the container C.

In some embodiments, the connector wire is divided into a first connector wire 610 connected to the light source plate 110 and a second connector wire 620 connected to the driver box 500. The connector terminal 600 is used for connecting the first connector wire 610 and the second connector wire 620. The second end of the first connector wire has a first connector terminal. The second end of the second connector wire 620 has a second connector terminal. the first connector terminal is connected to the second connector terminal. There is a butt splice 630 on the first connector wire 610 or the second connector wire 620.

When the first connector terminal and the second connector terminal are connected, the butt splice 630 encloses the connection of the first connector terminal and the second connector terminal.

In an embodiment, a wire pressing portion is set on the inner part of the downlight body 100. The wire pressing portion is used for pressing the first conductive wire 610. The first conductive wire 610 is pressed by the wire pressing portion after passing into the downlight body 100 from the first wire passing hole 511 on the side wall of the downlight body 100. The second conductive wire 620 passing into the driver box 500 from the second wire passing hole 512 on the side wall of the driver box 500. A first end of the second conductive wire 620 has a buckle portion 621 buckle connected with the second wire passing hole 512. The fastening sleeve 630 is set on the first conductive wire 610 or the second conductive wire 620. After the first connecting portion and the second connecting portion are connected, the fastening sleeve 630 is fastened on the external part of the first connecting portion and the second connecting portion. When the conductive wire is dragged, the force points are the wire pressing portion, the buckle portion 621 and the fastening sleeve 630. The connection point among the conductive wire, the downlight body 100 and the driver box 500 and the connection point between the first conductive wire 610 and the second conductive wire 620 are not the force points. Therefore, the stability of the conductive wire is guaranteed.

Figure 15:
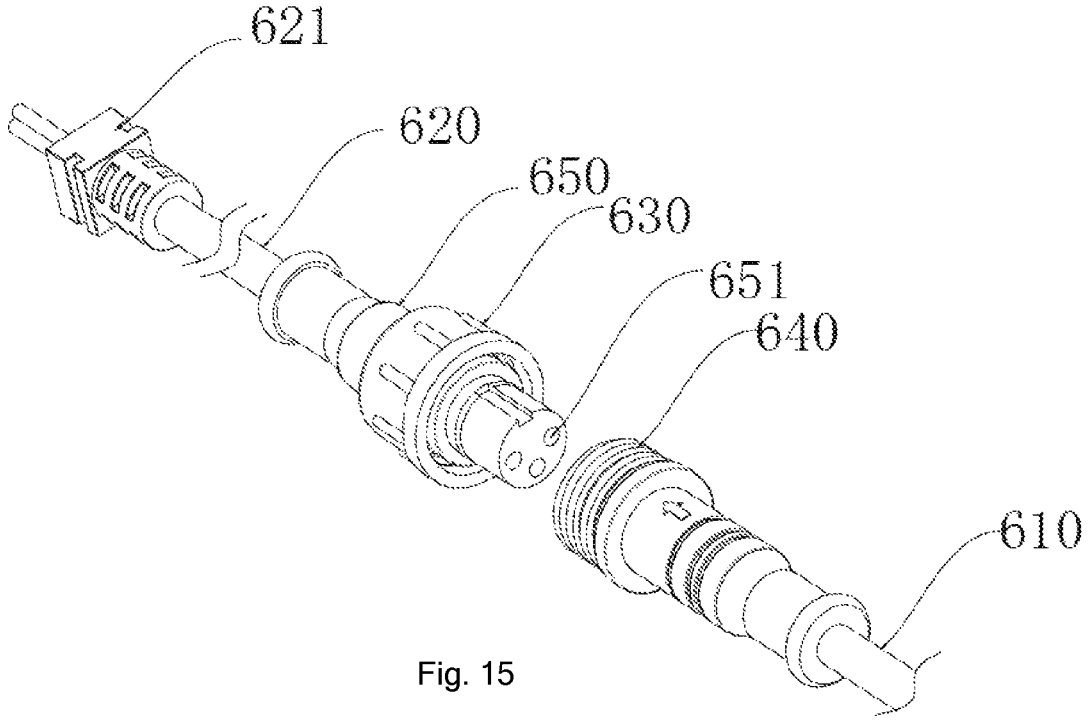
FIG. 15 illustrates a connecting wire example.
Figure 16:
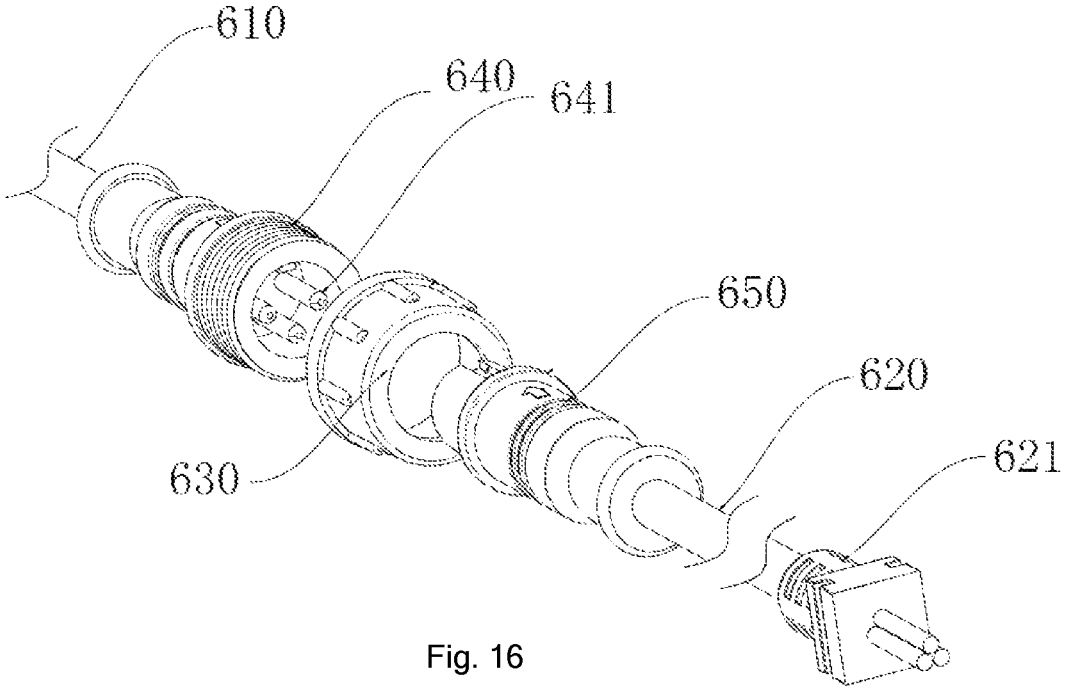
FIG. 16 illustrates another view of a connecting wire example.

In FIG. 15 and FIG. 16, the first connector part includes an electric plug 651 connected to the first connector wire 610, and a sleeve 640 fixed to the first connector wire 610. The sleeve 640 is a tube groove for the electric plug 641 disposed in the tube groove. There are three copper connectors in the sleeve 640 for connecting to core wires of the first connector wire 610.

The second connector part includes an electric socket 650 and an electric hole 651 inside the electrical socket 650. The electric socket 650 has a circular column shape with an external diameter of the electric socket 650 the same as the inner diameter of the sleeve 640 so that the electric socket 650 may be inserted into the sleeve 640. There are three electric holes 651 respectively connected to three copper terminals connected to core wires of the second connector wire 620.

The butt splice 630 is tube shape. The inner diameter of the butt splice 630 is equal or slightly larger than the external diameter of the sleeve 640 to ensure the butt splice 630 is firmly sleeved outside the sleeve 640 and the inner surface of the butt splice firmly engages the external surface of the sleeve 640.

There is an inner screw groove disposed inside the butt splice 630. There is corresponding screw shape on external surface of the sleeve 640 corresponding to the screw groove of the inner surface of the butt splice 630 to keep the first connector wire, the second connector wire and the butt splice connected firmly. When the first connector 610 needs to be disconnected from the second connector wire 620, the butt splice 630 is rotated with respect to the sleeve 640 along the screw groove to easily disconnect the first connector wire 610 from the connector wire 620.

Figure 17:
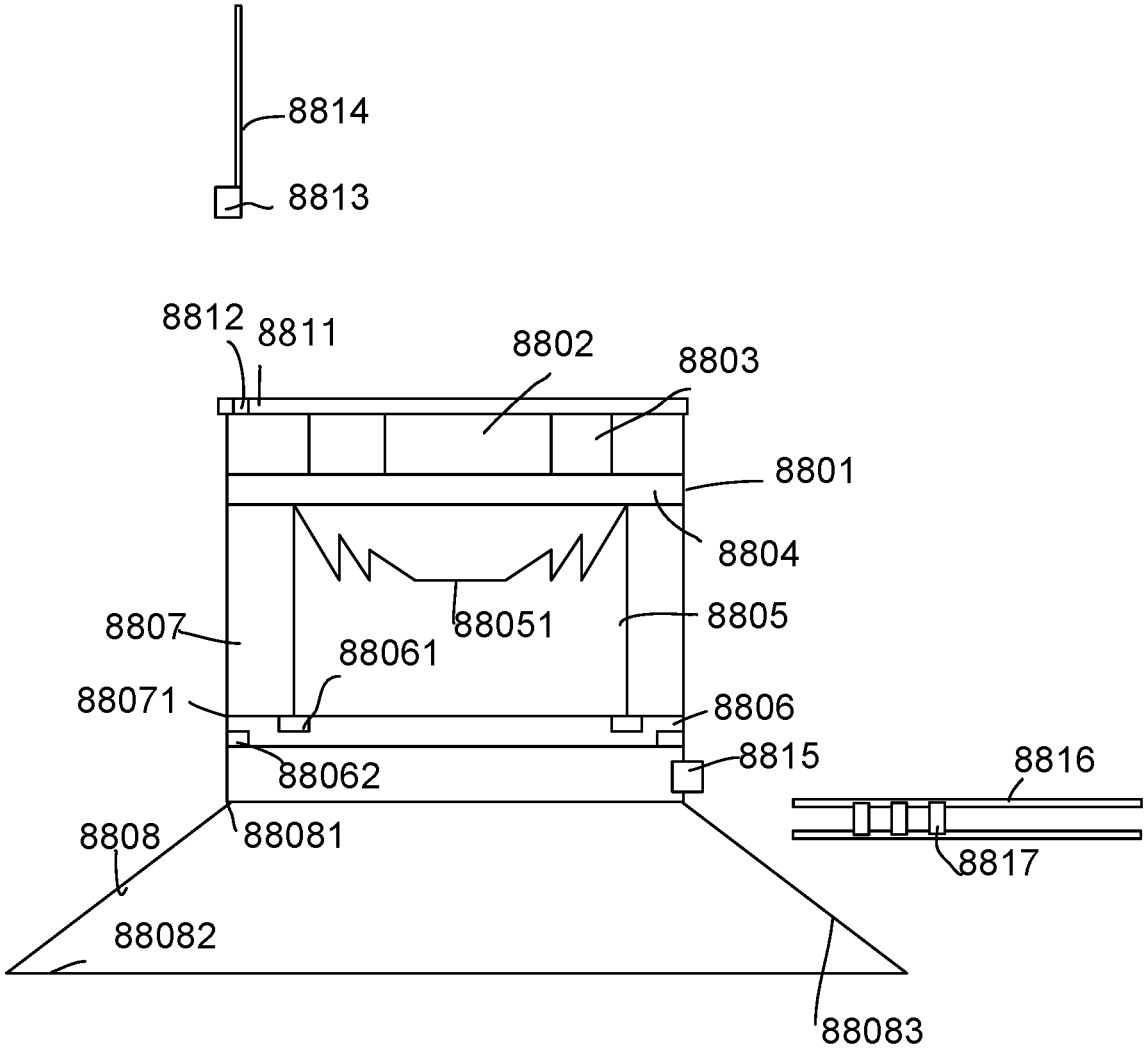
FIG. 17 illustrates a structure view of another embodiment.

In FIG. 17, a downlight apparatus includes a unibody housing 8801, a light source 8802, a light source plate 8803, a first fixing unit 8804, a lens module 8805 and a second fixing unit 8806.

The unibody housing 8801 is made of metal material. The unibody housing 8801 has a light source holder 8807 and a heat sink rim 8808. The heat sink rim 8808 has a top edge 88081 and a bottom edge 88082. The top edge 88081 is connected to the light source holder 8807. The top edge 88081 has a smaller diameter than the bottom edge 88082.

The light source plate 8803 is used for mounting the light source 8802. The lens module 8805 is fixed between the first fixing unit 8801 and the second fixing unit 8806 to align a center 88051 of the lens module 8805 with the light source 8802. The second fixing unit 8806 is fixed to a peripheral edge 88071 of the light source holder 8807 for keeping the lens module 8805, and the light source plate 8803 staying in the light source holder 8807.

In some embodiments, the downlight apparatus may also include a back cover 8811 attached on a top side of the light source holder 8807.

In some embodiments, the light source plate 8803 is fixed on the back cover 8811.

In some embodiments, the back cover 8811 is made of metal material.

In some embodiments, the back cover 8811 has a socket 8812 for plugging a terminal 8813 of a connecting wire 8814. The terminal 8813 of the connecting wire 8814 has a standard IDEAL plug structure. IDEAL plug structure is widely used in north American market. Usually, a light device provides a wire with an end terminal with IDEAL plug shape to be connected to anther IDEAL plug structure. In this embodiment, the IDEAL plug is directly disposed on the back cover 8811. Specifically, the IDEA plug does not need to be a complete IDEAL plug but has a compatible shape for receiving the terminal 8813 of the connection wire 8814.

In some embodiments, the light source holder has a lateral connector 8815 for fixing to a metal spring 8816 to transmit heat on the light source holder to the metal spring 8816. The metal spring has multiple fins 8817.

Figure 4:
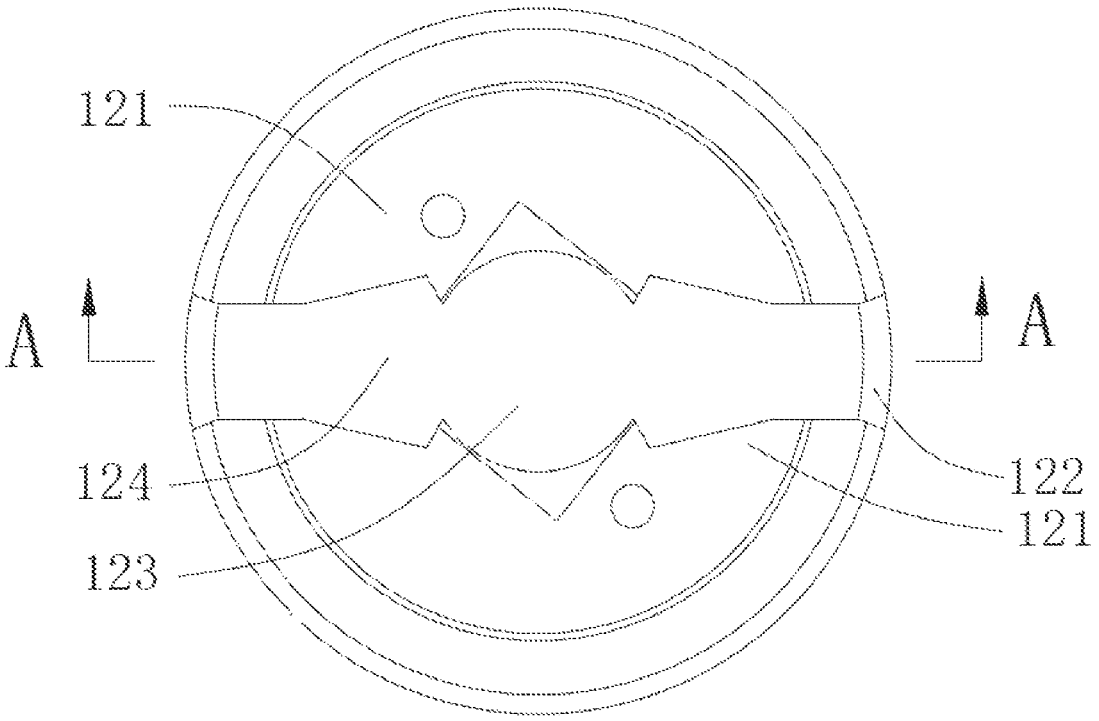
FIG. 4 illustrates an example of a first fixing unit.

In some embodiments, the light source is a LED chip on board (COB) module. The first fixing unit has an escape hole exposing the light source toward the lens module. This is illustrated in the example of FIG. 4.

In some embodiments, a connector wire is extended from the light source plate. The connector wire has a light terminal connected to a driver terminal of a driver box. This is illustrated in FIG. 2.

In some embodiments, the driver box has a manual switch to adjust a setting of a driver circuit enclosed by the driver box. This is illustrated in the example of FIG. 14.

Figure 18:
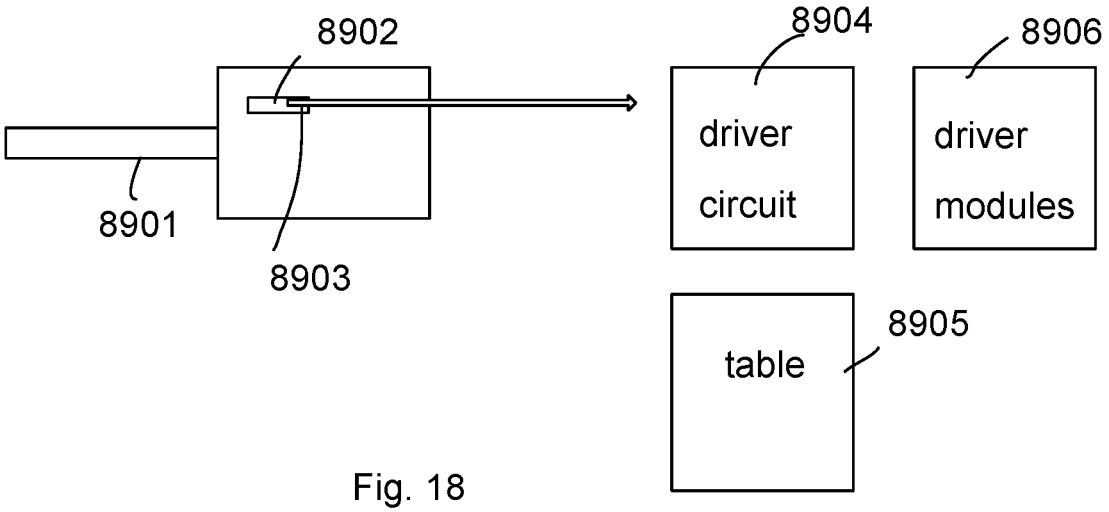
FIG. 18 shows a connector terminal containing identification message.

In FIG. 18, the light terminal 8901 has an identifier circuit 8902 providing an identification message 8903 corresponding to a type associated to the downlight apparatus to a driver circuit 8904 in the driver box. For example, the identifier circuit 8902 is stored in a memory circuit which content may be accessible by the driver circuit 8904. For example, the identifier circuit 8902 is a resistor storing a resistor value associated with the type of the downlight apparatus.

In some embodiments, the driver circuit 8904 checks a table 8905 for finding a corresponding setting for the type indicated by the identification message.

In some embodiments, the driver circuit 8904 has multiple driver modules 8906 and selects one driver module to activate according to the identification message.

In some embodiments, the lens module has more than three ring reflection structures facing to the light source. The ring reflection structure closer to the light source has a smaller diameter than the ring reflection structure more away from the light source. This is illustrated in the example of FIG. 7.

In some embodiments, the reflection structure has a vertical surface and a tilt surface connected at a bottom end facing downward to the light source plate.

In some embodiments, the vertical surface is attached with reflective material.

In some embodiments, the first fixing unit has an escape hole exposing the light source toward the lens module and has an escape groove for storing a wire connected to the light source plate. This is illustrated in the example of FIG. 4.

Figure 5:
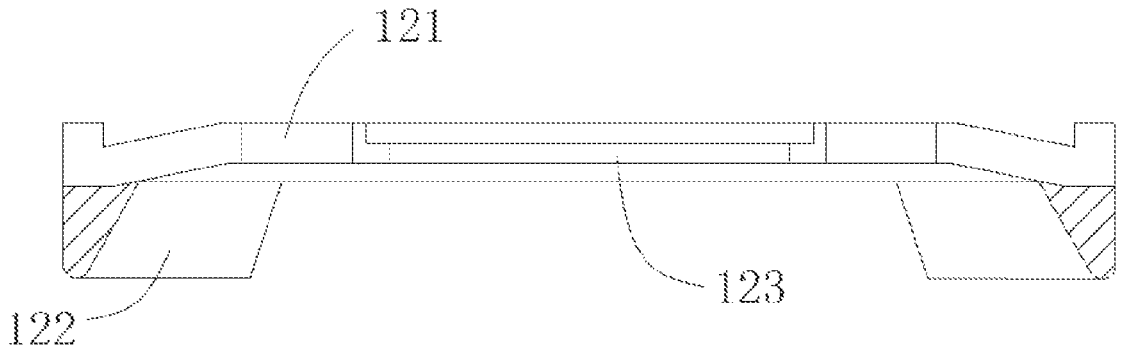
FIG. 5 illustrates another view of the first fixing unit in FIG. 4.

In FIG. 5, the first fixing unit has protruding blocks 122 engaging an inner surface of the light source holder for enhancing heat dissipation.

In FIG. 17, an exterior edge of the lens module 8805 is held by an inner connector 88061 of the second fixing unit 8806. The inner connector 88061 is located an inner side of the second fixing unit 8806.

In FIG. 17, an external connector 88062 is rotated to be locked to a protruding structure extended from an inner surface of the light source holder 8807. The protruding structure may find an example with reference numeral 130 in FIG. 10.

In FIG. 17, the heat sink rim has a reflective layer 88083 in an inner surface of the heat sink rim 8808.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A downlight apparatus comprising:

a unibody housing made of metal material, the unibody housing having a light source holder and a heat sink rim, the heat sink rim having a top edge and a bottom edge, the top edge being connected to the light source holder and the top edge having a smaller diameter than the bottom edge;

a light source;

a light source plate for mounting the light source;

a first fixing unit;

a lens module; and a second fixing unit, the lens module being fixed between the first fixing unit and the second fixing unit to align a center of the lens module with the light source, wherein the second fixing unit is fixed to a peripheral edge of the light source holder for keeping the lens module, and the light source plate staying in the light source holder, wherein a connector wire is extended from the light source plate and has a light terminal connected to a driver terminal of a driver box, wherein the light terminal has an identifier circuit providing an identification message corresponding to a type associated to the downlight apparatus to a driver circuit in the driver box.

2. The downlight apparatus of claim 1, further comprising a back cover attached on a top side of the light source holder.

3. The downlight apparatus of claim 2, wherein the light source plate is fixed on the back cover.

4. The downlight apparatus of claim 2, wherein the back cover is made of metal material.

5. The downlight apparatus of claim 2, wherein the back cover has a socket for plugging a terminal of a connecting wire, the terminal of the connecting wire has a standard IDEAL plug structure.

6. The downlight apparatus of claim 1, wherein the light source holder has a lateral connector for fixing to a metal spring to transmit heat on the light source holder to the metal spring, the metal spring has multiple fins.

7. The downlight apparatus of claim 1, wherein the light source is a LED chip on board (COB) module, and the first fixing unit has an escape hole exposing the light source toward the lens module.

8. The downlight apparatus of claim 1, wherein the driver box has a manual switch to adjust a setting of a driver circuit enclosed by the driver box.

9. The downlight apparatus of claim 1, wherein the driver circuit checks a table for finding a corresponding setting for the type indicated by the identification message.

10. The downlight apparatus of claim 1, wherein the driver circuit has multiple driver modules and selects one driver module to activate according to the identification message.

11. The downlight apparatus of claim 1, wherein the lens module has more than three ring reflection structures facing to the light source, the ring reflection structure closer to the light source has a smaller diameter than the ring reflection structure more away from the light source.

12. The downlight apparatus of claim 11, wherein the reflection structure has a vertical surface and a tilt surface connected at a bottom end facing downward to the light source plate.

13. The downlight apparatus of claim 12, wherein the vertical surface is attached with reflective material.

14. The downlight apparatus of claim 1, wherein the first fixing unit has an escape hole exposing the light source toward the lens module and has an escape groove for storing a wire connected to the light source plate.

15. The downlight apparatus of claim 14, wherein the first fixing unit has protruding blocks engaging an inner surface of the light source holder for enhancing heat dissipation.

16. The downlight apparatus of claim 1, wherein an exterior edge of the lens module is held by an inner connector of the second fixing unit, the inner connector is located an inner side of the second fixing unit.

17. The downlight apparatus of claim 1, wherein an external connector is rotated to be locked to a protruding structure extended from an inner surface of the light source holder.

18. The downlight apparatus of claim 1, wherein the heat sink rim has a reflective layer in an inner surface of the heat sink rim.

* * * * *